United States Patent [19]

Warner

[11] 4,289,091

[45] Sep. 15, 1981

[54] CLOSED APPARATUS FOR COATING THE INTERIOR OF A TANK

[75] Inventor: Hubert H. Warner, Pekin, Ill.

[73] Assignee: Caterpillar Tractor Co., Peoria, Ill.

[21] Appl. No.: 973,042

[22] Filed: Dec. 13, 1978

[51] Int. Cl.[3] ..... B05C 3/02

[52] U.S. Cl. ..... 118/642; 118/61; 118/64; 118/73; 118/600; 118/408; 118/DIG. 3; 427/230

[58] Field of Search ..... 427/230, 235; 134/12, 134/40, 11, 22 R; 118/408, DIG. 3, 61, 64, 73, 600, 64, 642

[56] References Cited

U.S. PATENT DOCUMENTS

| | | | |
|---|---|---|---|
| 2,024,248 | 12/1935 | Rafton | 118/61 |
| 2,668,782 | 2/1954 | Gross | 134/22 R |
| 3,046,163 | 7/1962 | Kearney | 134/11 |

*Primary Examiner*—Sam Silverberg

*Attorney, Agent, or Firm*—Charles E. Lanchantin, Jr.

[57] ABSTRACT

A closed apparatus (10) and method for coating the interior of a tank (12) includes a plurality of interconnected conduits (36, 40, 60, 178), valves (34, 58) and a pump (62) for supplying a coating solution to the tank and draining the tank while containing deleterious fumes. Another plurality of conduits (66, 42), valve (64), and a pump (68) can work therewith to supply a hot curing solution to the tank.

13 Claims, 2 Drawing Figures

HEATER
TANK 12
CONTROL CONSOLE 14
BULK $CO_2$ TANK
VENT
V REL
DIRECTIONAL CONTROL VALVE
SOLVENT RECOVERY DEVICE
SOLVENT TANK
$CO_2$ TANK
HOT CURING SOLUTION TANK 32
COATING SOLUTION TANK 30
CLEANING SOLVENT TANK 28
SEPARATOR
CURING SOLUTION TANK

CLOSED APPARATUS FOR COATING THE INTERIOR OF A TANK

DESCRIPTION

1. Technical Field

This invention relates to the field of coating the inside surfaces of a tank, such as a fuel tank, and particularly to an apparatus for doing some while the apparatus contains noxious fumes.

2. Background Art

Liquid coating solutions are known which can form a thin elastomeric or plastic film of material on the inside surfaces of a tank. Such a film, of about 0.05 to 0.10 mm (0.002 to 0.004") thickness, can minimize condensation and rust formation within the tank, can seal small cracks, and can serve to contain weld spatter of foreign particles on the interior surfaces of the fabricated, ferrous sheets of the tank.

One family of liquid coating solutions of the elastomeric or rubberized coating type is particularly useful for coating the inside of a tank containing oil or fuel, since it is resistant to such liquids. But, unfortunately, such family incorporates an appreciable proportion of a solvent known as methyl isobutyl ketone (MIBK) for carrying the nitrile rubber phenolic resin material. This ketone solvent carrier produces deleterious or noxious fumes and, in addition, is relatively volatile. A great deal of time and manual labor is involved in filling and emptying the tank of the liquid coating solution, in supplying a gas to the interior of the tank to dilute the fumes, and in supplying a hot gas to cure the film of the coating on the inside walls of the tank. Moreover, it is desirable to recover and reuse the solvent and/or the various gases and liquids used in the process, and this gives rise to the need for filters and separators adding to the complexities of the apparatus.

The present invention is directed to overcoming one or more of the problems as set forth above.

DISCLOSURE OF INVENTION

In accordance with one aspect of the present invention, an apparatus includes first means for connecting a tank into a substantially closed system, second means for supplying a diluting gas to the tank and reducing the oxygen level therein, and third means for applying a coating solution to the inside surfaces of the tank, draining the solution therefrom and forming a film thereon while containing fumes from the coating solution.

In accordance with another aspect of the invention, a closed apparatus for coating the interior of a tank includes: a coating solution tank; a reversible fluid pump; first means for connecting a bottom opening of the tank, the pump and the coating solution tank; a solvent recovery device; second means for connecting a top opening of the tank to the solvent recovery device; and third means for supplying a diluting gas to the tank.

In accordance with a further aspect of the invention, a closed apparatus for coating the inside of a tank includes: a cleaning solvent tank; a coating solution tank; first means for selectively connecting the cleaning solvent tank and the coating solution tank to a bottom opening of the tank; and second means for supplying a diluting gas to the cleaning solution tank and the coating solution tank.

In accordance with a still further aspect of the invention, a closed apparatus for coating the interior of a tank includes: a cleaning solvent tank; a coating solution tank; a curing solution tank; a conduit connected to the tank; and control valve means for selectively connecting the cleaning solvent tank, the coating solution tank, and the curing solution tank to the conduit.

Advantageously, the present invention provides conditions of relatively low volatility throughout the apparatus and monitors the substantially enclosed system to sequentially direct liquids and/or gases therethrough and to and from the tank, while containing same.

BEST MODE FOR CARRYING OUT THE INVENTION

Figure 1:
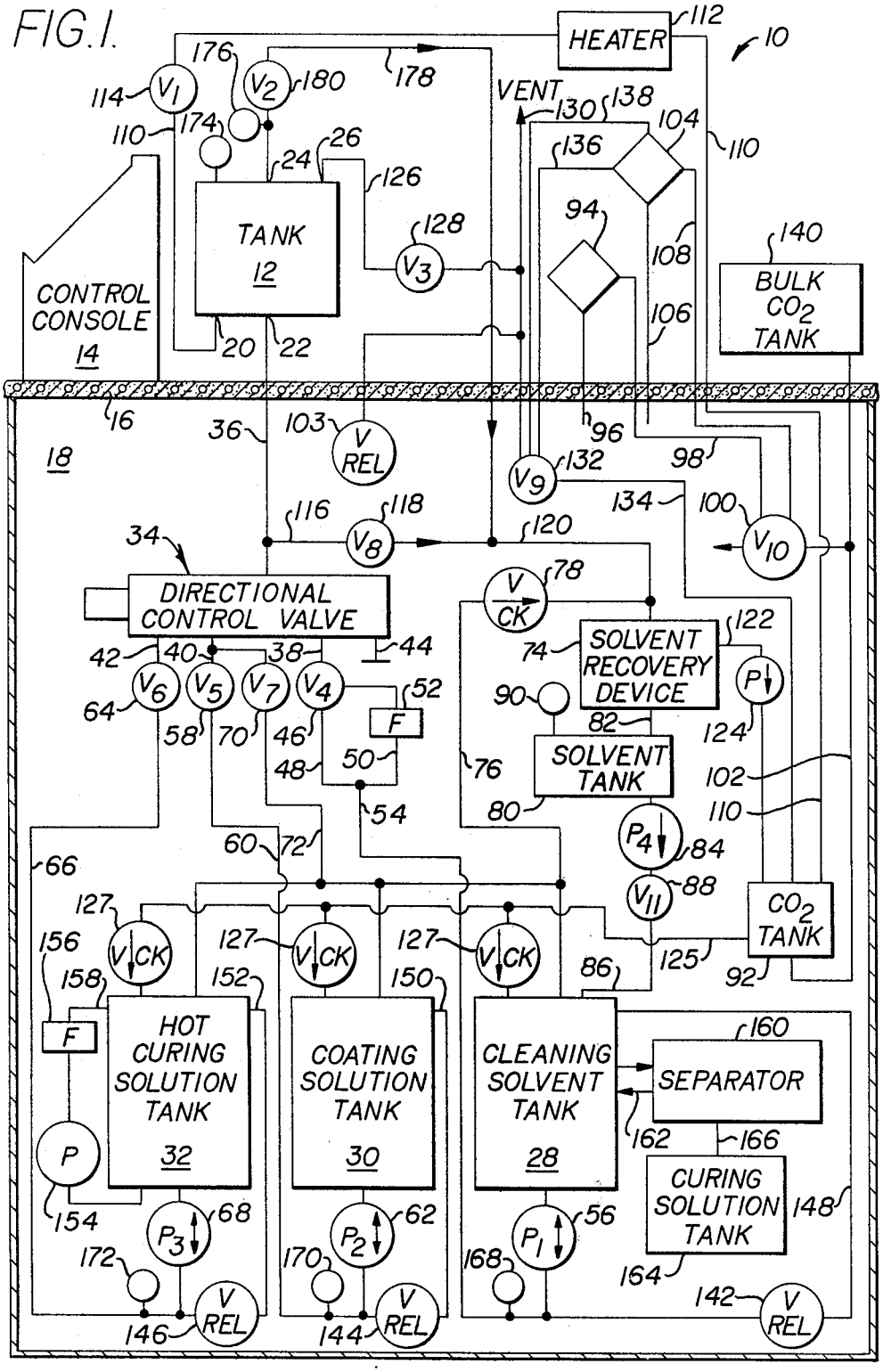
FIG. 1 is a diagrammatic elevational view of a substantially enclosed apparatus for coating the interior surfaces of a tank in accordance with the present invention.

Referring to the drawing, there is shown a closed apparatus or tank coating system 10 for coating the interior of a tank 12, such as a vehicle fuel tank, hydraulic tank, water tank, or the like. The tank and a control console 14 for operation of the apparatus are advantageously located elevationally above a separating floor 16 which forms the ceiling of an enclosed or substantially gastight room 18. The fuel tank 12 is initially manually connected to the system at connection points or couplings 20,22,24 and 26 and remains a part of the substantially closed system until the coating process has been concluded, whereupon another fuel tank is connected to the system in its place.

In general, liquids in the three storage tanks 28,30 and 32 are directed sequentially to and away from the fuel tank 12 by remote manipulation of a four-position directional control valve 34. A main line or conduit 36 leading between the directional control valve and the fuel tank is thereby placed into fluid communication with similar conduits 38,40 and 42, leading to the three storage tanks, or alternately is blocked as is schematically indicated at 44. A valve 46 is connected to the conduit 38 and is selectively connected to either a conduit 48 or a conduit 50 having a filter 52 disposed therein. The first or cleaning solvent tank 28 is connected to the conduits 48,50 through a conduit 54 and a first reversible fluid pump 56. Likewise, a valve 58 is connected to the conduit 40 and to a conduit 60 leading to the second or coating solution tank 30 via a second reversible fluid pump 62. And, a valve 64 is connected to the conduit 42 and to a conduit 66 leading to the third or hot curing solution tank 32 via a third reversible fluid pump 68.

A valve 70 is also connected to the conduit 40 and to a conduit 72 communicating with the elevationally upper portions of the tanks 28,30 and 32 for communicating fumes or gases to a solvent recovery device 74 via a conduit 76 having a one-way check valve 78 therein. The solvent recovery device 74 has a suitable cooling and condenser apparatus, as known in the art (not shown), to convert the solvent fumes to liquid solvent and to deliver same to a small solvent storage tank 80 via a conduit 82. A fourth pump 84 directs the liquid solvent back to the main cleaning solvent tank 28 via a conduit 86 having a shut-off valve 88. When a fluid level sensor 90 is tripped or energized indicating that the fluid level in the tank 80 has reached a preselected level, then the control console 14 reacts thereto to operate the pump 84 and to open the valve 88 for reducing the fluid level to a relatively low amount. At this point the fluid level sensor 90 turns off the pump 84 and closes the valve 88 to allow the solvent fluid level in the tank 80 to rise again.

The closed room 18 is preferably provided with a reducing type atmosphere under about 35 kPa (5 psi) pressure above standard atmospheric pressure. In the instant example, carbon dioxide ($CO_2$) gas is supplied to the room from a storage tank 92, although it is contemplated that any dilution gas selected from the group consisting of carbon dioxide, nitrogen and argon would be satisfactory for reducing the oxygen level and relative proportion of solvent fumes within the room. The automatically operated mechanism to do this includes a hydrocarbon concentration analyzer 94 having a conduit 96 communicating with the gas in the closed room. If the level of solvent fumes in the room increases beyond a preselected volumetric percent, then a signal line 98 from the analyzer to a valve 100 is energized to automatically cause the valve to open and carbon dioxide gas to enter the room from a supply conduit 102 connected to the tank 92. When the pressure in the room is increased to about the 35 kPa (5 psi) pressure, a relief valve 103 opens to release excess gas to the atmosphere.

In much the same way as the hydrocarbon concentration analyzer 94, an oxygen concentration analyzer 104 is mounted above the floor 16 and has a conduit 106 leading into the room 18. If the level of oxygen increases beyond a preselected volumetric percent of the gases in the room, then a signal line 108 also leading to the valve 100 is energized automatically to open the valve 100 and to increase the level of carbon dioxide in the room.

The dilution gas can be supplied to the fuel tank 12 from the storage tank 92 by way of a supply conduit 110 having a conventional heater unit 112 and an on-off valve 114 in series therewith. The dilution gas can exit the tank 12 via the conduit 36, a branch conduit 116, an on-off valve 118, and an extension conduit 120 communicating with the solvent recovery device 74. From the solvent recovery device the dilution gas can be returned to the storage tank 92 via a conduit 122 having a pump 124 therein. Furthermore, the pressurized dilution gas in the storage tank 92 is in continual communication with the upper ends of the tanks 28, 30 and 32 via a conduit 125 and individual one-way check valves 127 to provide a relatively low preselected pressure level above atmospheric thereat.

Air can exit the fuel tank 12 via a conduit 126 having another on-off valve 128, and can be communicated from that valve to a vent conduit 130 leading to a point spaced from the control console and tank area, for example the exterior of the building in which the closed apparatus 10 is received.

The oxygen concentration analyzer 104 also is capable of monitoring the oxygen concentration in the dilution gas storage tank 92, for example at a valve 132 connected to the tank 92 via a conduit 134. If the oxygen level in the dilution gas storage tank 92 undesirably exceeds a preselected volumetric percent at a conduit 136 leading to the valve 132, then a signal line 138 is automatically energized to pass a signal to the valve 132 and to vent a portion of the dilution gas to the vent conduit 130. A bulk storage tank 140 connected to the supply conduit 102 is adapted to automatically refill the storage tank 92 and to maintain a preselected pressure level.

The output conduits 54,60 and 66 from each of the main pumps 56,62 and 68 are advantageously protected from overpressurization by conventional pressure relief valves 142,144 and 146 respectively. For example, should the pressure in conduit 54 be elevated beyond a preselected value, for example 240 kPa (35 psi), then the valve 142 would automatically open to return fluid back to the tank 28 via the return conduit 148. Likewise, the relief valve 144 relieves fluid pressure in the conduit 60 via a return conduit 150, and the relief valve 146 relieves fluid pressure in the conduit 66 via a return conduit 152.

The hot curing solution in the tank 32 is preferably continually filtered to remove solid contaminants as by a recirculation system embodying a pump 154 and a filter 156 disposed in a recirculation conduit 158.

As some residual portion of the hot curing solution can get into the cleaning solvent tank 28, an oil-liquid solvent separator 160 is contemplated for returning relatively clean liquid solvent to the tank 28 via a conduit 162 and directing the separated oil to a recovery tank 164 via a conduit 166.

In addition to the fluid level sensor 90 associated with the solvent storage tank 80, fluid level sensors 168,170 and 172 are associated with the conduits 54,60 and 66 respectively for indicating fluid levels therein. Another fluid level sensor 174 is associated with the fuel tank 12, as is a pressure level sensor 176. The pressure level sensor 176 is in communication with a conduit 178 having an on-off valve 180 with the conduit 178 being connected between the fuel tank and the extension conduit 120 leading to the solvent recovery device 74.

Industrial Applicability

In general, the closed apparatus 10 eliminates as much manual handling of the fuel tank 12 as possible, while simultaneously providing a savings of time and labor during the sequential steps of coating and curing the coating on the interior of the fuel tank. In actual operation, the instant embodiment uses the previously mentioned methyl isobutyl ketone (MIBK) carrier solvent that has been recovered from the coating solution to flush the fuel tank 12 and remove oil and foreign material from the interior thereof. The fuel tank is thereafter filled and drained with the previously mentioned coating solution of the MIBK carrier solvent and nitrile rubber phenolic resin and a solvent recovery stage preliminarily sets the coating. Then the fuel tank is preferably filled and drained with oil to cure the coating.

For the entire operation, the control console 14 serves as a minicontroller and nerve center with appropriate electrical circuitry connected to the various valves and sensors of the system, not shown, so that the following operational sequence can be appropriately carried out:

Step (a)—The fuel tank 12 is manually connected to the closed apparatus 10 at the connections 20,22,24 and 26.

Step (b)—The programmed control sequence is started at the control console 14 by manually pushing a button or the like, not shown. Valves 114 and 128 are thereby automatically opened permitting carbon dioxide or other dilution gas to purge the fuel tank. Specifically, heated carbon dioxide under pressure communicates with the fuel tank 12 from the storage tank 92 via the supply conduit 110 and the heater 112. Simultaneously, a substantial proportion of the retained air in the fuel tank 12 is forced out the top via the conduit 126 and opened valve 128 to the vent conduit 130.

Step (c)—After a preselected period of time, for example 30 seconds, the control console 14 automatically closes the valve 128 to allow the carbon dioxide gas to pressurize the fuel tank 12.

Step (d)—Pressure level sensor 176 acts through the control console 14 to close valve 114 at a preselected pressure, for example about 140 kPa (20 psi) above atmospheric pressure. In the event that the preselected pressure at the pressure level sensor is not reached, or if the pressure thereat drops below a second lower preselected pressure after a preselected period of time, for example about 100 kPa (15 psi) after 30 seconds, then the control console automatically stops the coating process to enable an operator to check the system for leakage.

Step (e)—At the end of the pressure cycle of Step (d) valve 180 is automatically opened, the directional control valve moves from a closed first position of radial alignment with the blocked conduit 44 to a second axial position communicating the main conduit 36 with the conduit 38. Simultaneously, valve 46 automatically opens and the first pump 56 is actuated to supply MIBK liquid solvent in the tank 28 to the fuel tank 12 at a preselected rate, for example, 380 l/min (100 gpm). Opened valve 180 permits the fumes from the solvent entering the fuel tank and the carbon dioxide gas to go to the solvent recovery device 74 via conduits 178 and 120. Also, carbon dioxide enters the top of the solvent tank 28 via the check valve 127 preventing a vacuum thereat.

Step (f)—When the MIBK liquid solvent substantially reaches the full position as indicated by the level sensor 174, the level sensor is energized to signal the control console 14, valve 114 is opened, valve 180 is closed, the valve 46 changes its position to directly communicate conduits 38 and 50, and the first pump 56 reverses direction to drain the liquid solvent from the fuel tank 12 via the filter 52 and return it to the cleaning solvent tank 28. Pressurized carbon dioxide entering the fuel tank from the conduit 110 accelerates draining, and any pressure in the top of the solvent tank 28 is vented via conduit 76 and check valve 78.

Step (g)—When the conduit 54 is empty as indicated by the fluid level sensor 168, the sensor is automatically energized to signal the control console 14 and thereafter valve 46 is closed and the directional control valve 34 moves to a third axial position communicating the main conduit 36 with the conduit 40. The valve 114 is closed and the valves 180 and 58 are opened and the second pump 62 pumps the liquid coating solution in the tank 30 to the fuel tank 12 via conduits 60,40 and 36.

Step (h)—Fluid level sensor 174 detects a substantial full tank of the coating solution, and through communication with the control console 14 closes valves 180, opens valve 114, and reverses the pump 62 under the direction of the control console 14. This drains the liquid coating solution from the fuel tank 12, leaving an uncured film on the interior surfaces thereof, and returns it to the tank 30.

Step (i)—When the fluid level sensor 170 indicates an absence of the coating solution fluid in the conduit 60 and that the fuel tank 12 has been drained, then valve 58 is closed, and valves 70 and 180 are opened permitting a hot dilution gas solvent extraction step to be initiated. Specifically, for example, hot carbon dioxide in the conduit 110 flows into the fuel tank 12 at connection point 20, out the tank at 24, and to the solvent recovery device 74 via conduits 178 and 120. At the same time the liquified solvent in the fuel tank can pass by gravity and flow of the carbon dioxide gas back down the conduits 36, 40 and 72 and to the solvent recovery device 74 via the check valve 78. This is continued for a preselected period of time, for example about 3 to 5 minutes, and partially cures the film on the interior of the fuel tank.

Step (j)—At the end of Step (i) the control console 14 moves directional control valve 34 to a fourth position communicating the main conduit 36 with the conduit 42, valves 70 and 114 close, valves 64 and 180 open and the third pump 68 pumps a hot curing solution, preferably oil for example at about 150° C. (300° F.), up into the fuel tank 12 via conduits 66, 42 and 36.

Step (k)—Level sensor 174 detects when the fuel tank 12 is full of the hot solution, and the control console thereafter reacts thereto and closes valve 64 and stops the pump 68 for a preselected period of time, for example 20 minutes, in order to cure and harden the film of the coating on the interior surface of the fuel tank.

Step (l)—After the time period of Step (k) the control console 14 automatically closes valve 180 and opens valves 64 and 114 and the third pump 68 is reversed to drain the oil from the fuel tank 12 and return it to the tank 32.

Step (m)—When the conduit 66 and thus the fuel tank 12 is empty of oil, the level sensor 172 signals the control console 14 which closes valve 64, moves the directional control valve 34 back to the first or blocked position and pressurizes the fuel tank 12 with the hot carbon dioxide gas via the conduit 110. The pressure sensor 176 senses the pressure increase to about 140 kPa (20 psi) whereupon a signal is directed to the control console and valve 114 is subsequently closed.

Step (n)—If after a preselected period of time, for example 10 minutes, the pressure level of about 140 kPa (20 psi) is retained, then the fuel tank coating operation is complete and valve 128 opens to vent the fuel tank to the atmosphere via the vent conduit 130.

In each of the Steps e, g, and j of filling the fuel tank 12 with liquid, it is to be noted that positive pressure is provided by the carbon dioxide gas in the conduit 125 via each of the check valves 127 to the upper ends of the respective tanks 28, 30 and 32. Furthermore, during each of the Steps f, h and l of draining liquids from the fuel tank, positive pressure is provided by the carbon dioxide gas in the conduit 110 to accelerate such action. In either instance pulling of a vacuum is advantageously avoided.

Figure 2:
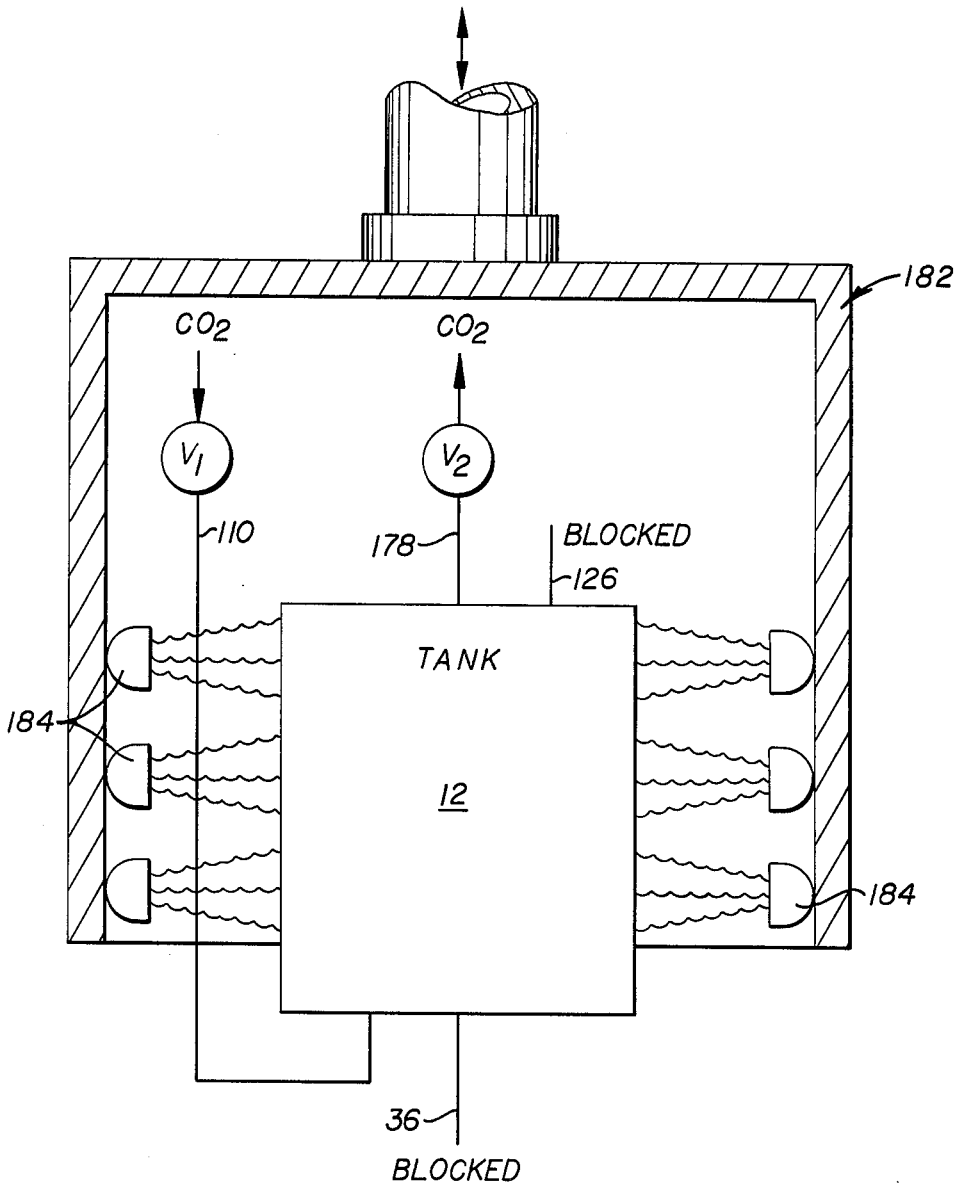
FIG. 2 is a diagrammatic and fragmentary elevational view showing an alternate embodiment device for curing the film on the interior surfaces of the tank simultaneously with supplying a gas to the tank with the apparatus of FIG. 1.

Referring now to FIG. 2, a fragmentary view of the fuel tank 12 is illustrated along with portions of the conduits 36, 110, 126 and 178 previously discussed. However, in this alternate embodiment hot oil curing of the film on the interior of the fuel tank has been replaced by radiation heat curing. Specifically, after previously discussed Step (i), an infrared radiation heating device 182 is elevationally lowered over the fuel tank so that a plurality of infrared heat sources 184 are in proximity to the external peripheral surfaces of the fuel tank. Simultaneously, carbon dioxide gas is communicated into the tank from the conduit 110 and out of the tanks by way of conduit 178.

In view of the foregoing, it is apparent that the closed apparatus 10 minimizes manual handling of the tank 12 during applying a film to the inside surfaces thereof and during subsequent curing of the film. Advantageously, deleterious fumes from the carrier solvent in the coating solution are contained within the apparatus, are converted back to a liquid by the recovery device 74, and are returned to the liquid solvent storage tank 28 for economic reuse during initial cleaning of the tank. In addition, the oxygen level is continually monitored in the room 18 and in the dilution gas storage tank 92, and the hydrocarbon level is continually monitored in the room 18 to maintain a relatively low level of volatility thereat. It is contemplated also, that the subject apparatus can be utilized with coating solutions containing carrier solvents other than the ketone family.

Other aspects, objects and advantages of this invention can be obtained from a study of the drawings, the disclosure and the appended claims.

I claim:

1. A closed apparatus (10) for coating the interior of a first tank (12), comprising:

first means (20, 22, 24, 26) for connecting the first tank (12) to the apparatus (10) and providing a substantially closed system;

second means (92, 110, 114, 126, 128) for supplying a diluting gas to the first tank (12), controllably purging air from the first tank (12), and reducing the oxygen level therein;

third means (30, 62, 60, 34, 36, 178, 180, 120, 74, 80) for applying a coating solution that can form deleterious fumes to the interior of the first tank (12), draining the coating solution from the first tank (12), forming a film on the interior of the first tank (12), and containing the fumes within the closed apparatus (10), said third means including a second tank (30) for containing a supply of the coating solution, conduit means (60, 34, 36) for connecting the first and second tanks (12, 30), and a reversible pump (62) disposed in series with said conduit means (60, 34, 36); and fourth means (32, 68, 66, 34, 36, 184) for heating and hardening the film while containing the fumes within the apparatus (10), and wherein said fourth means (32, 68, 66, 34, 36, 184) includes a third tank (32) for containing a supply of hot curing solution, second conduit means (66, 34, 36) for connecting the first and third tanks (12, 32), and a second reversible pump (68) disposed in series with said second conduit means (66, 34, 36).

2. A closed apparatus (10) for coating the interior of a tank (12), comprising:

first means (20, 22, 24, 26) for connecting the tank (12) to the apparatus (10) and providing a substantially closed system;

second means (92, 110, 114, 126, 128) for supplying a diluting gas to the tank (12), controllably purging air from the tank (12), and reducing the oxygen level therein;

third means (30, 62, 60, 34, 36, 178, 180, 120, 74, 80) for applying a coating solution that can form deleterious fumes to the interior of the tank (12), draining the coating solution from the tank (12), forming a film on the interior of the tank (12), and containing the fumes within the closed apparatus (10);

fourth means (32, 68, 66, 34, 36, 184) for heating and hardening the film while containing the fumes within the apparatus (10);

a substantially enclosed room (18) for containing a substantial portion of each of said third means (30, 62, 60, 34, 36, 178, 180, 120, 74, 80) and fourth means (32, 68, 66, 34, 36, 184); and means (92, 102, 100, 96, 94, 98, 106, 108, 104) for controllably supplying said room (18) with the diluting gas providing a preselected reducing gas atmosphere therein.

3. A closed apparatus (10) for coating the interior of a tank (12) having a bottom opening (22) and a top opening (24), comprising:

a solvent tank (28);

a reversible pump (56) connected to said solvent tank (28);

first means (54, 48, 46, 38, 36, 34) for connecting said bottom opening (22) of said tank (12) and said reversible pump (56);

a coating solution tank (30);

a second reversible fluid pump (62) connected to said coating solution tank (30);

second means (60, 58, 40, 34, 36) for connecting said bottom opening (22) of said tank (12) and said second reversible fluid pump (62);

a solvent recovery device (74);

third means (178, 180, 120) for connecting said top opening (24) of said tank (12) to said solvent recovery device (74);

fourth means (92, 110, 112, 114, 20) for supplying a diluting gas to the tank (12) and reducing the oxygen level therein, the diluting gas being capable of passing through the tank (12) and third means (178, 180, 120) to the solvent recovery device (74);

a substantially closed room (18), said tank (12) being located outside of said room (18), said second reversible fluid pump (62) and said coating solution tank (30) being located in said room (18); and means (92, 100, 102, 94, 104) for controllably supplying a reducing gas to said room (18).

4. A closed apparatus (10) for coating the interior of a tank (12) having a bottom opening (22) and a top opening (24), comprising:

a solvent tank (28);

a reversible pump (56) connected to said solvent tank (28);

first means (54, 48, 46, 38, 36, 34) for connecting said bottom opening (22) of said tank (12) and said reversible pump (56);

a coating solution tank (30);

a second reversible fluid pump (62) connected to said coating solution tank (30);

second means (60, 58, 40, 34, 36) for connecting said bottom opening (22) of said tank (12) and said second reversible fluid pump (62);

a solvent recovery device (74);

third means, (178, 180, 120) for connecting said top opening (24) of said tank (12) to said solvent recovery device (74);

fourth means (92, 110, 112, 114, 20) for supplying a diluting gas to the tank (12) and reducing the oxygen level therein, the diluting gas being capable of passing through the tank (12) and third means (178, 180, 120) to the solvent recovery device (74);

a curing solution tank (32);

a third reversible fluid pump (68) connected to the curing solution tank (32); and fifth means (66, 64, 42, 34, 36) for connecting said bottom opening (22) of said tank (12) and said third reversible fluid pump (68).

5. The closed apparatus (10) of claim 4 wherein said first means (54, 48, 46, 38, 34), said second means (60,

58, 40, 34, 36), and said fifth means (66, 64, 42, 34) includes a common directional control valve (34).

6. A closed apparatus (10) for coating the interior of a tank (12) having a bottom opening (22) and a top opening (24), comprising:

a solvent tank (28);

a reversible pump (56) connected to said solvent tank (28);

first means (54, 48, 46, 38, 36, 34) for connecting said bottom opening (22) of said tank (12) and said reversible pump (56);

a coating solution tank (30);

a second reversible fluid pump (62) connected to said coating solution tank (30);

second means (60, 58, 40, 34, 36) for connecting said bottom opening (22) of said tank (12) and said second reversible fluid pump (62);

a solvent recovery device (74);

third means (178, 180, 120) for connecting said top opening (24) of said tank (12) to said solvent recovery device (74);

fourth means (92, 110, 112, 114, 20) for supplying a diluting gas to the tank (12) and reducing the oxygen level therein, the diluting gas being capable of passing through the tank (12) and third means (178, 180, 120) to the solvent recovery device (74); and heating means (178, 182) for heating the tank (12) exteriorly thereof while said fourth means (92, 110, 112, 114, 20) maintains the interior of the tank (12) at a reduced oxygen level.

7. A closed apparatus (10) for coating the interior of a tank (12) comprising:

a cleaning solvent tank (28);

a coating solution tank (30);

first means (54, 48, 38, 60, 40, 34, 36) for selectively connecting the cleaning solvent tank (28) and the coating solution tank (30) to the tank (12); and second means (127, 125, 92) for supplying a diluting gas to the cleaning solvent tank (28) and the coating solution tank (30) preventing a vacuum thereat.

8. A closed apparatus (10) for coating the interior of a tank (12) having a bottom opening (22), comprising:

a cleaning solvent tank (28);

a coating solution tank (30);

a curing solution tank (32);

a conduit (36) connected to the bottom opening (22) fo the tank (12);

control valve means (34, 38, 40, 42) for selectively connecting the cleaning solvent tank (28), the coating solution tank (30), and the curing solution tank (32) to the conduit (36); and delivery means (127, 125, 92) for supplying an oxygen diluting gas to the cleaning solvent tank (28), the coating solution tank (30) and the curing solution tank (32).

9. The closed apparatus (10) of claim 8 including an enclosed room (18) containing the cleaning solvent tank (28), the coating solution tank (30) and the curing solution tank (32), and means for controllably supplying the room (18) with a diluting gas providing a reducing gas atmosphere therein.

10. A closed apparatus (10) for coating the interior of a first tank (12), comprising:

first means (30, 62, 60, 34, 36, 178, 180, 120, 74, 80) for applying a coating solution that can form deleterious fumes to the interior of the first tank (12) and forming a film thereon while containing the fumes, said first means including a second tank (30) for containing a supply of the coating solution, conduit means (60, 34, 36) for connecting the first and second tanks (12, 30), and a reversible pump (62) disposed in series with said conduit means (60, 34, 36); and second means (32, 68, 66, 34, 36, 184) for heating and hardening the film while containing the fumes including a third tank (32) for containing a supply of hot curing solution, second conduit means (66, 34, 36) for connecting the first and third tanks (12, 32), and a second reversible pump (68) disposed in series with said second conduit means (66, 34, 36).

11. A closed apparatus (10) for coating the interior of a tank (12), comprising:

first means (30, 62, 60, 34, 36, 178, 180, 120, 74, 80) for applying a coating solution that can form deleterious fumes to the interior of the tank (12), draining the coating solution from the tank (12), forming a film on the interior of the tank (12), and containing the fumes;

second means (32, 68, 66, 34, 36, 184) for heating and hardening the film while containing the fumes;

a substantially enclosed room (18) for containing a substantial portion of each of said first means (30, 62, 60, 34, 36, 178, 180, 120, 74, 80) and second means (32, 68, 66, 34, 36, 184); and means (92, 102, 100, 96, 94, 98, 106, 108, 104) for controllably supplying said room (18) with a diluting gas providing a preselected reducing gas atmosphere therein.

12. A closed apparatus (10) for coating the interior of a tank (12) having a bottom opening (22) and a top opening (24), comprising:

a coating solution tank (30);

a reversible fluid pump (62) connected to the coating solution tank (30);

means (60, 58, 40, 34, 36) for connecting said bottom opening (22) of said tank (12) and said reversible fluid pump (62);

a substantially closed room (18), said tank (12) being located outside of said room (18), said reversible fluid pump (62) and said coating solution tank (30) being located in said room (18); and means (92, 100, 102, 94, 104) for controllably supplying a reducing gas to said room (18).

13. A closed apparatus (10) for coating the interior of a tank (12) having a bottom opening (22) and a top opening (24), comprising:

a coating solution tank (30);

a reversible fluid pump (62) connected to said coating tank (30);

means (60, 58, 40, 34, 36) for connecting said bottom opening (22) of said tank (12) and said reversible fluid pump (62);

a curing solution tank (32);

a second reversible fluid pump (68) connected to said curing solution tank (32); and means (66, 64, 42, 34, 36) for connecting said bottom opening (22) of said tank (12) and said second reversible fluid pump (68).

* * * * *